US009064682B2

(12) United States Patent
Vries

(10) Patent No.: US 9,064,682 B2
(45) Date of Patent: Jun. 23, 2015

(54) UV-ENHANCER ARRANGEMENT FOR USE IN A HIGH-PRESSURE GAS DISCHARGE LAMP

(71) Applicant: KONINKLIJKE PHILIPS N.V., Eindhoven (NL)

(72) Inventor: Franciscus Leonardus Gerardus Vries, Gemert (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/361,550

(22) PCT Filed: Nov. 30, 2012

(86) PCT No.: PCT/IB2012/056868

§ 371 (c)(1),
(2) Date: May 29, 2014

(87) PCT Pub. No.: WO2013/080176

PCT Pub. Date: Jun. 6, 2013

(65) Prior Publication Data

US 2014/0320001 A1 Oct. 30, 2014

Related U.S. Application Data

(60) Provisional application No. 61/566,040, filed on Dec. 2, 2011.

(51) Int. Cl.

| | |
|---|---|
| ***H01J 61/54*** | (2006.01) |
| ***H01J 61/073*** | (2006.01) |
| ***H01J 9/32*** | (2006.01) |
| ***H01J 61/36*** | (2006.01) |

(52) U.S. Cl.
CPC ..... *H01J 61/547* (2013.01); *H01J 9/323* (2013.01); *H01J 61/363* (2013.01); *H01J 61/54* (2013.01); *H01J 61/0735* (2013.01)

(58) Field of Classification Search
None
See application file for complete search history.

(56) References Cited

U.S. PATENT DOCUMENTS

| | | | | |
|---|---|---|---|---|
| 4,881,009 | A | 11/1989 | Passmore | |
| 5,057,048 | A | 10/1991 | Feuersanger | |
| 5,426,343 | A | 6/1995 | Rhodes | |
| 5,811,933 | A | 9/1998 | Van Den Nieuwenhuizen | |
| 6,392,343 | B1 | 5/2002 | Luijks | |
| 6,633,127 | B2 | 10/2003 | Vos | |
| 2008/0093963 | A1 * | 4/2008 | Marien et al. | 313/113 |
| 2010/0224242 | A1 | 9/2010 | Chang | |
| 2011/0177747 | A1 | 7/2011 | Patrician | |
| 2012/0025688 | A1 * | 2/2012 | Ohkahara et al. | 313/113 |

FOREIGN PATENT DOCUMENTS

| | | | |
|---|---|---|---|
| EP | 1298706 | A2 | 4/2003 |
| JP | 2004288617 | A | 10/2004 |
| JP | 201129577 | A | 2/2011 |

(Continued)

*Primary Examiner* — Ashok Patel

(57) ABSTRACT

A high pressure gas discharge lamp comprising a discharge vessel, an outer envelope enclosing said discharge vessel with an interspace between the outer envelope and the discharge vessel. A UV-enhancer having a wall enclosing an electrode space with a filling gas and an internal electrode extending from the electrode space through the wall to the interspace. Said UV-enhancer is arranged in said interspace between the outer envelope and the discharge vessel, said wall of the UV-enhancer being made of ceramic material and contains said filling gas. The electrode is directly sealed into the wall.

8 Claims, 1 Drawing Sheet

(56) References Cited

FOREIGN PATENT DOCUMENTS

| | | | |
|---|---|---|---|
| WO | 9802902 | A1 | 1/1998 |
| WO | 9848447 | A1 | 10/1998 |
| WO | 0077825 | A1 | 12/2000 |
| WO | 2009115574 | A1 | 9/2009 |

* cited by examiner

UV-ENHANCER ARRANGEMENT FOR USE IN A HIGH-PRESSURE GAS DISCHARGE LAMP

CROSS-REFERENCE TO PRIOR APPLICATIONS

This application is the U.S. National Phase application under 35 U.S.C. §371 of International Application No. PCT/IB2012/056868, filed on Nov. 30, 2012, which claims the benefit of U.S. Provisional Patent Application No. 61/566,040, filed on Dec. 2, 2011. These applications are hereby incorporated by reference herein.

FIELD OF THE INVENTION

The invention relates to a high-pressure gas discharge lamp comprising a discharge vessel, an outer envelope enclosing said discharge vessel with an interspace between the outer envelope and the discharge vessel, an UV-enhancer having a wall enclosing an electrode space with a filling gas and an internal electrode extending from the electrode space through the wall to the interspace, said UV-enhancer being arranged in said interspace between the outer envelope and the discharge vessel, said wall of the UV-enhancer being made of ceramic material.

BACKGROUND OF THE INVENTION

A known problem in high-pressure discharge lamps in general is the ignition of these lamps. Dependent on the type of lamp, a relatively high ignition voltage is required, which is generally supplied in the form of one or more ignition voltage pulses to the lamp by a starter. In practice, there may be an inadmissibly long ignition time, even when the ignition voltage pulses are sufficiently high, while furthermore a large spread of this ignition delay is obtained. This is the result of a shortage of primary electrons in the discharge vessel, introducing the lamp discharge during ignition. By adding a small quantity of a radioactive element 85Kr in the discharge vessel, the shortage of primary electrons can be eliminated so that the ignition time will become shorter and its spread is reduced. 85Kr has the drawback that it is radioactive, and its use can be avoided by using an UV enhancer. This is a relatively small discharge vessel that produces UV radiation and is placed in the proximity of the discharge vessel of the lamp. When the lamp is ignited, the UV radiation emitted by the UV enhancer ensures that there are sufficient primary electrons in the discharge vessel of the lamp.

A lamp of the type described in the opening paragraph is known from WO98/02902 (U.S. Pat. No. 5,811,933). The known lamp is a high-pressure discharge lamp, more particularly a metal halide lamp. This lamp has a discharge vessel with two lamp electrodes. The material of the discharge vessel may be quartz glass or a ceramic material. In this description and the claims, a ceramic material is understood to mean a densely sintered polycrystalline metal oxide, such as aluminum oxide or yttrium aluminum garnet, or a densely sintered polycrystalline metal nitride such as aluminum nitride. An outer envelope supporting a lamp cap surrounds the discharge vessel. The space between the discharge vessel and the outer envelope accommodates an UV enhancer, which has a wall of ceramic material and is provided with an enhancer electrode, which is connected to a first lamp electrode, and with a capacitive coupling. This capacitive coupling is realized by placing the UV enhancer in the proximity of a supply wire to a second lamp electrode. The use of a capacitively coupled UV enhancer as compared with an enhancer with two internal electrodes has the advantage that the enhancer is only operative when this is necessary, namely during the start phase of the lamp when ignition voltage pulses having a relatively high voltage and a high frequency are presented. Consequently, the enhancer does not consume energy during operation of the lamp and thus has a very long lifetime.

The use of a ceramic material for the wall of the UV enhancer has a favorable influence on the ignition behavior of the lamp, because the UV radiation generated by a ceramic UV enhancer appears to considerably increase the possibility of introducing the lamp discharge (lamp breakdown). However, the known lamp has the drawback that the UV enhancer itself is relatively difficult and relatively expensive to manufacture.

SUMMARY OF THE INVENTION

It is an object of the invention to provide measures of counteracting the above-mentioned drawback. According to the invention, a high-pressure discharge lamp of the type described in the opening paragraph is characterized in that the electrode is directly sealed into the wall and in that the material of the ceramic wall contains a gas substantially of a same composition as a composition of the filling gas. Said filling gas generally is a noble/rare gas, i.e. at least one of helium, neon, argon, xenon, and krypton (note: with avoidance of radioactive 85Kr). Preferably said rare gas is neon, argon or xenon. Substantially of the same composition in this respect means that the composition of the gas in the ceramic wall is at least for 75 atom % (at %) the same as the composition of the filling gas. For example, if the filling gas is 100% neon, the composition of the gas enclosed in the ceramic wall has a composition which at least contains for 75 at % neon and at the most 25 at % of other gases. A technique to realize direct seals is via shrink sealing. The UV enhancer usually has a wall of densely sintered polycrystalline aluminum oxide. This material is often used in the manufacture of high-pressure discharge lamps, so that an existing technology for ceramic discharge vessels can be employed, allowing miniaturization within strict tolerance limits. In the known UV-enhancers the electrode is sealed into the wall by means of a sealing glass, requiring extra steps in the manufacturing process of the UV-enhancer. Yet, this process is generally applied, as the process can be performed under a (chosen) gas atmosphere and at normal pressures of around 1 bar. Though the possibility of direct sealing of an Nb electrode in the wall as such is known, the general opinion is that this direct sealing has to be performed under vacuum or circumstances proximate to vacuum to avoid detrimental effects on the translucency of the ceramic wall and hence possibly on the UV-output, and/or to avoid detrimental effect on the seal for example to prevent reaction of Nb with gas, such as with hydrogen. Such process under vacuum is generally considered much more expensive and complicated than the comparable process under a (chosen) gas atmosphere at normal pressure. For these reasons, the manufacture of UV-enhancers with a directly sealed electrode has never been considered. Surprisingly the inventors have found that that direct sealing under gas atmosphere is possible without detrimental effects on the seal and without meaningful detrimental effects on the UV-enhancing properties of the UV-enhancer. Various methods can be followed to obtain the direct seal.

A first method comprises the two steps of:

pre-sealing of the electrode, which can either be a metal tube, rod, foil or wire, under a H2-atmosphere at about 1450-1600° C. Without being held to theoretical considerations, it is thus thought that a not yet gastight pre-seal between wall of the UV-enhancer and electrode is obtained as the sintered ceramic wall material as such is already gastight;

final-sealing of the electrode under a filling gas-atmosphere, for example argon, at a desired gas pressure and at a temperature of about 1850° C. such that after cooling down the desired filling gas pressure is present in the electrode space of the UV-enhancer when a rod, wire of foil is used as electrode. Alternatively, when a tube is used, the gas pressure is easily set to the desire pressure after the sealing and subsequently the tube is closed by means of a metal drop formed by melting an end of the tube with a laser.

Without being held to theoretical considerations it is thought that exchange of the gas in the electrode space from H2 to filling gas occurs via a not yet completely sealed interface between wall of the UV-enhancer and the electrode surface due to the rough surface of the electrode. Since in the first process step the PCA was already sintered to a certain degree of closed porosity it subsequently is sintered to full density in the second process step.

A second, relatively fast, flexible and cheap method comprises only one step, i.e. direct sealing at about 1850° C. of the electrode in the wall of the UV-enhancer under a rare gas atmosphere at desired gas pressure, such that after cooling down the desired filling gas pressure is present in the electrode space of the UV-enhancer when a rod, wire of foil is used as electrode. Alternatively, when a tube is used, the gas pressure is easily set to the desire pressure after the sealing and subsequently the tube is closed by means of a metal drop formed by melting an end of the tube with a laser.

Without being held to theoretical considerations it is thought that the following occurs: At the start of both these methods the ceramic material of the wall has an open porous structure enabling the pores in the structure to be filled with the gas used at the start of both the methods. In the first method, the first process step is sintering at about 1500° C. and a first shrinkage of the fully open porous structure occurs, enough for the wall material to shrink tightly around the electrode and thus to directly embed the electrode in the ceramic wall. However, said first shrinkage is not enough to fully close the open porous structure. Hence, in the second process step of the first method a change of gas atmosphere is done and subsequently a second further sintering and some shrinkage at about 1850° C. occurs. Due to the still somewhat open structure at the beginning of said second process step, at least to a large extent an exchange of the gases from the first process gas (H2) to the second process gas (filling gas, for example xenon or argon) occurs in the pores of the ceramic material and is enclosed in the ceramic material of the wall as gas inclusions, in particular adjacent the interface between ceramic wall material and electrode. The enclosed gas in the ceramic wall thus has a composition close to the composition of the filling gas, i.e. said enclosed gas is at least for 75 at %, for example for 90 at % or more, of the same composition as the composition of the filling gas.

In the second method, the gas used at the start of the process is the filling gas and at a process temperature of about 1850° C. full shrinkage occurs in one step during which said filling gas is enclosed throughout and homogeneously in the ceramic material of the wall.

Said first and second method both have the advantage over the prior art that the cumbersome or expensive manufacture steps under vacuum, required for direct sealing and as used in the prior art processes, are avoided. Both inventive processes have the characteristic effect that the filling gas, such as argon gas is captured or enclosed in the remaining pores of the ceramic material of the wall and/or adjacent the interface of ceramic wall and electrode, or in other words that filling gas inclusions are present in the ceramic wall.

Said first method has the advantage that the translucency of the ceramic material, for example PCA, of the wall of the UV-enhancer is relatively high, while in the second method the translucency of the PCA wall is somewhat reduced compared to the translucency of the wall of the UV-enhancer obtained via the first method. Yet the translucency of the UV-enhancer wall obtained by the second method still is adequate to enable the UV-enhancer to serve its purpose.

Both the methods have the advantage that the extra step of closing of the electrode tube, for example by a laser or arc melting, is avoidable, thus rendering the advantage that the use of electrode rods, wires and foils is enabled. Furthermore said methods are faster and cheaper methods compared to the prior art methods using a sealing glass. On the other hand, laser closing enables easily setting of the desired gas pressure inside the electrode space of the UV-enhancer.

The second method has the advantage over the first method that it is simpler, faster and cheaper than the first method.

Direct sealing further has the advantage that the necessary creepage distance in a lamp, to counteract flashover between the UV-enhancer and the discharge vessel, may be shorter as with UV enhancers using a sealing glass. This is especially advantageous in gas filled lamps. Generally the sealing glass is electrically conductive, leading to shorter creepage distances. Hence, lamps with a directly sealed UV-enhancer enable a position of the UV-enhancer closer to the discharge vessel than in the known prior art lamps and hence a more compact lamp is obtainable.

In a preferred embodiment the high pressure gas discharge lamp is characterized in that the electrode is made from a metal or metal alloy, the metal being chosen from the group consisting of Niobium, Molybdenum, Tungsten, Iridium, Ruthenium and Rhenium. These metals have suitable chemical and physical properties, i.e. a relatively good oxidation resistance at elevated temperatures and a coefficient of thermal expansion matching with the coefficient of thermal expansion of PCA, to function correctly under the lamp circumstances during lifetime of the lamp. Nb has a coefficient of thermal expansion that matches very well with the coefficient of thermal expansion of PCA, however, Nb is relatively sensitive to oxidation. Mo, W and Re have a better resistance to oxidation than Nb, but the match in thermal expansion with PCA is worse than for Nb. Ir has both a good match in thermal expansion with PCA and has an excellent oxidation resistance, but is expensive.

In another embodiment of the high pressure gas discharge lamp is characterized in that the electrode is made from a mixture of metal or metal alloy and a ceramic material (cermet), the metal being chosen from the group consisting of Niobium, Molybdenum, Tungsten, Ruthenium, Iridium and Rhenium, the ceramic material being chosen from the group $Al_2O_3$, $Y_2O_3$, $Y_3Al_5O_{12}$, $ZrO_2$, MgO, $MgAL_2O_4$, $B_2O_3$ and mixtures thereof. Cermets are composite materials made of both ceramic and metallic components especially suitable for use in lighting applications. The composite materials have a coefficient of expansion similar to the coefficient of thermal expansion of PCA, have a comparably good electrical conductivity and a relatively high corrosion resistance against, for example, various halides as used in the gas filling of metal halide lamps.

In a preferred embodiment, the UV enhancer has a wall of well-known densely sintered yttrium aluminum garnet (YAG), or polycrystalline aluminum oxide (PCA), or has a wall from PCA doped with MgO, MgO—Er2O3 or MgO—Er2O3-ZrO2 as this material seems to result in a favorable lower flash-over voltage for ignition of the lamp than in the case when undoped PCA is used.

In an advantageous embodiment the enhancer electrode has a lead-through at a first extremity of the UV enhancer, the extremity of the enhancer electrode within the UV enhancer is spaced apart from the first extremity of the UV enhancer by a distance which is at least equal to twice the external diameter of the UV enhancer. In such a construction, the possibility of an unwanted breakdown between the metal curl and the lead-through to the enhancer electrode is very small when ignition pulses are supplied.

A combination of mercury and a rare gas is possible as a filling for the UV enhancer. However, a rare gas or a mixture of rare gases is preferred, because this precludes the use of the heavy metal mercury. Very satisfactory results are obtained when using argon as a filling for the UV enhancer. At about room temperature, the filling pressure of the rare gas filling is then preferably chosen to be in the range from 50 to 300 mbar. At pressure values of less than 50 mbar, the UV output of the enhancer appears to become smaller; at pressure values of more than 300 mbar, the ignition voltage of the enhancer may assume too high values.

Preferably the UV enhancer is situated in the proximity of a lamp electrode, with its longitudinal axis being substantially parallel to the longitudinal axis of the lamp. In this embodiment, it is achieved that a maximal quantity of the UV radiation generated in the enhancer directly impinges upon the lamp electrode, which is favorable for generating secondary electrons in the lamp.

BRIEF DESCRIPTION OF THE DRAWINGS

The aspects described above and further aspects of the lamp according to the invention will now be elucidated with reference to a drawing, in which.

DETAILED DESCRIPTION OF PREFERRED EMBODIMENTS

Figure 1:
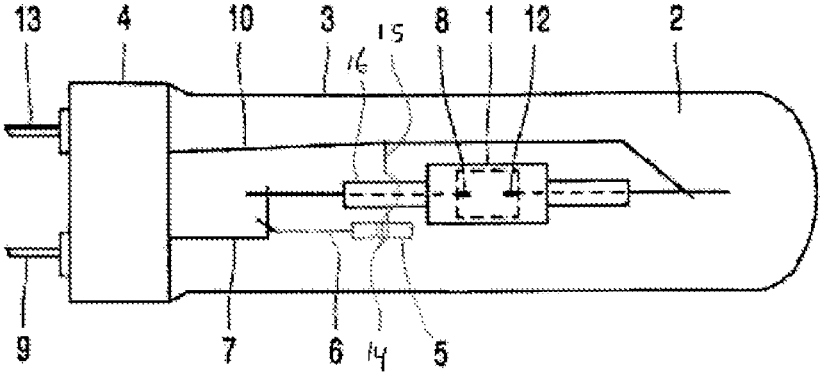
FIG. 1 is a side elevation of a lamp according to the invention.

FIG. 1 shows a high-pressure metal halide lamp comprising a discharge vessel 1 surrounded with an interspace 2 by an outer envelope 3, which supports a lamp cap 4. The discharge vessel 1 is made of densely sintered polycrystalline aluminum oxide and has a first lamp electrode 8 and a second lamp electrode 12, which electrodes are connected to contacts 9 and 13 on the lamp cap 4 by means of current supply wires 7 and 10, respectively. The lamp is provided with an UV enhancer 5, which is situated in the interspace 2. Said UV-enhancer is positioned in close proximity to a connection between the current supply wire 7 and electrode 8 inside an end part (VUP) 16. The UV enhancer has an internal enhancer electrode (not shown here; see 42 in FIG. 2) which is connected to the first lamp electrode 8 by means of a lead-through wire 6. The UV enhancer has a capacitive coupling with the second lamp electrode 12. This coupling is constituted by a metal curl 14, which is connected to the second lamp electrode 12 through a conductor 15.

Figure 2:
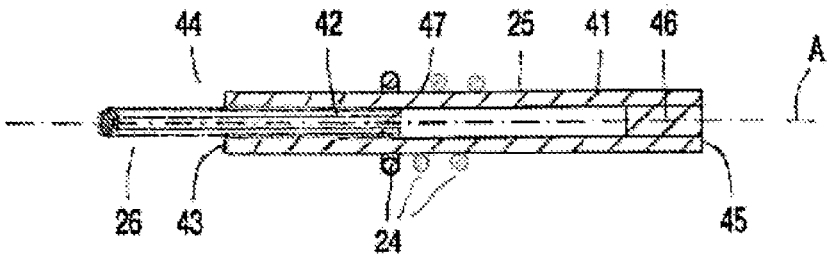
FIG. 2 shows the UV enhancer of the lamp of FIG. 1 in greater detail.

FIG. 2 shows the UV enhancer with a longitudinal axis A, of the lamp of FIG. 1, in a cross-section and in greater detail. The wall 41 of the enhancer 25 is made of a ceramic material. In a practical embodiment, this wall is made of a densely sintered polycrystalline aluminum oxide doped with 300 ppm MgO and 50 ppm Er2O3. The enhancer is provided with an enhancer electrode 42 having a lead-through 26 at a first extremity 43 of the enhancer, which lead-through is intended to be connected to a first lamp electrode. The lead-through 26 is directly connected in a vacuum-tight manner to the wall 41 without the use of a melt glass but via direct sealing using the process of:

- sealing of a metal tube in the wall of the UV-enhancer at about 1500° C. under a H2-gas atmosphere;
- final sealing at about 1850° C. under an argon atmosphere followed by adjusting the argon pressure to about 150 mbar; and
- closing the metal tube by means of a laser under said Ar-gas pressure.

At a second extremity 45, the enhancer is sealed in a vacuum-tight manner by means of a sintered plug 46. A metal curl 24 intended to be connected to a second lamp electrode surrounds the UV enhancer 25 in a plane transverse to the longitudinal axis A of the enhancer. To obtain a suitable capacitive coupling, the metal curl 24 must be situated in the proximity of the extremity 47 of the enhancer electrode 42 within the UV enhancer. The distance between the extremity 47 and the plane in which the curl 24 is situated is preferably at most equal to the external diameter of the UV enhancer. In the embodiment shown in FIG. 2, the extremity 47 is situated substantially in the plane of the curl 24. The UV enhancer 25 has a length of 10 mm, an external diameter of 2 mm and an internal diameter of 0.675 mm. The electrode 42 and the lead-through 26 constitute one assembly of Nb wire with a diameter of 0.0.72 mm. The electrode extremity 47 is spaced apart from the first extremity 43 of the enhancer by a distance of 4.5 mm. This 4.5-mm distance is larger than twice the external diameter (2.0 mm) of the enhancer. This minimizes the possibility of breakdown between the metal curl 24 and the lead-through 26. The metal curl 24 is formed as a single turn of Nb wire having a wire diameter of 0.72 mm. It is possible to form the curl in a multiple turn, but this does not yield extra advantages. The UV enhancer 25 is filled with argon gas having a pressure of 150 mbar±50 mbar, in the figure having a filling pressure of 150 mbar.

Figure 3:
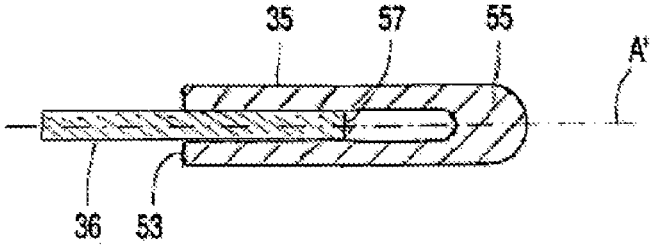
FIG. 3 shows a further embodiment of an UV enhancer of a lamp according to the invention.

FIG. 3 shows a further embodiment of an UV enhancer of a lamp according to the invention. The UV enhancer 35, with longitudinal axis A', has a wall of densely sintered polycrystalline aluminum oxide doped with 300 ppm Mg and 50 ppm Er. A directly sealed Molybdenum rod is sealed at about 1850° C. as the electrode in the wall of the UV-enhancer under an Ar-gas atmosphere of 1 bar as an enhancer electrode 36 at a first extremity 53. After cooling down, the argon pressure inside of the UV-enhancer drops from about 1 bar to about 125 mbar. The electrode 36 has an internal extremity 57 at a distance of 4.5 mm from the first extremity 53. The UV enhancer 35 has a second extremity 55 in the form of an injection molded dome. Instead of providing the UV-enhancer with a separate capacitive coupling metal curl, it is alternatively possible for an UV-enhancer of the type of FIG. 3 to be positioned behind an electrode adjacent the lead-through conductor at an angle (of for example 45°) to the longitudinal axis of the discharge vessel, for example in a way as is shown in FIG. 3 of U.S. Pat. No. 5,811,933. However, such a positioning at such small distance from the discharge vessel requires a very good heat resistance of the wall of the UV-enhancer as well as from the electrode. The enhancer 35 has a length of about 10 mm, an external diameter of 2.0 mm and an internal diameter of 0.675 mm and is filled with argon.

A number of lamps having a construction as shown in FIG. 1 was subjected to an ignition test. As is shown in FIG. 1, the UV enhancer in these lamps is situated in the proximity of a lamp electrode, with its longitudinal axis parallel to the longitudinal axis of the lamp. The lamp electrode is thereby directly irradiated by the UV radiation generated in the enhancer. The lamps were connected to a power supply source of 220 V, 50 Hz via a stabilization ballast provided with an ignition circuit. The ignition circuit comprises a starter, type SN57/SN58 (Philips), with a capacitor being arranged parallel to the lamp, so that ignition pulses having a maximum value of 3.0 kV and a pulse width of 7 μs are supplied. The ignition pulses are supplied to the lamp electrode that is connected to the enhancer electrode. The UV output of the enhancer was then found to be satisfactory. Prior to the ignition test, the lamps were operated for 10 to 15 minutes and subsequently switched off and maintained in a dark room for at least 55 minutes. The test was performed at various instants during the lifetime of the lamps (0, 100, 1000, 2000 hrs). All lamps ignited after an ignition time that was well within the requirement of 30 s. The following Table 1 states the results of the tests. The heading 'Mu' denotes the percentage of non-ignited lamps after the specified time (in seconds (s) or minutes (min)) of each batch of lamps.

TABLE 1

Ignition test results for CDM-T(c)70 W/930 Elite+ with HID-PV C 70 W min-min Driver, using flash cycle (BU = base up, BD = base down).

| sealing method | lamp test | lamp age (h) | position | pole | Mu 2 s | Mu 5 s | Mu 10 s | Mu 30 s | Mu 2.5 min | Mu 5 min | Mu 15 min |
|---|---|---|---|---|---|---|---|---|---|---|---|
| direct (invention) | UVe80 | 0 | BD | LP | 1.0% | 0.0% | 0.0% | 0.0% | 0.0% | 0.0% | 0.0% |
| direct (invention) | UVe80 | 1000 | BD | LP | 11.0% | 0.0% | 0.0% | 0.0% | 0.0% | 0.0% | 0.0% |
| CDM seal glass | UVe6 | 100 | BD | LP | 4.2% | 0.0% | 0.0% | 0.0% | 0.0% | 0.0% | 0.0% |
| CDM seal glass | UVe6 | 1000 | BD | LP | 6.8% | 3.2% | 1.1% | 0.0% | 0.0% | 0.0% | 0.0% |
| CDM seal glass | UVe6 | 2000 | BD | LP | 0.0% | 0.0% | 0.0% | 0.0% | 0.0% | 0.0% | 0.0% |
| SON seal glass | UVe19 | 100 | BU | LP | 0.0% | 0.0% | 0.0% | 0.0% | 0.0% | 0.0% | 0.0% |
| SON seal glass | UVe19 | 1000 | BU | LP | 0.0% | 0.0% | 0.0% | 0.0% | 0.0% | 0.0% | 0.0% |
| SON seal glass | UVe19 | 2000 | BU | LP | 0.0% | 0.0% | 0.0% | 0.0% | 0.0% | 0.0% | 0.0% |

It is clearly apparent that there was only a very small ignition delay at relatively low ignition voltage pulses (3.0 kV). Furthermore, the spread of this ignition delay appeared to be very small.

The protective scope of the invention is not limited to the embodiments described. The invention resides in each and every novel feature and each and every combination of features. Reference numerals in the claims do not limit their protective scope. Use of the verb "comprise" and its conjugations does not exclude the presence of elements other than those stated in the claims. Use of the article "a" or "an" preceding an element does not exclude the presence of a plurality of such elements.

The invention claimed is:

1. A high pressure gas discharge lamp comprising a discharge vessel, an outer envelope enclosing said discharge vessel with an interspace between the outer envelope and the discharge vessel, a UV-enhancer having a wall enclosing an enhancer electrode space with a filling gas and an enhancer electrode extending from the enhancer electrode space through the wall to the interspace, said UV-enhancer being arranged in said interspace between the outer envelope and the discharge vessel, said wall of the UV-enhancer being made of ceramic material, whereby the enhancer electrode is directly sintered onto the wall of the UV enhancer characterized in that the enhancer electrode is a closed metal tube.

2. A high pressure gas discharge lamp as claimed in claim 1, characterized in that the metal tube is closed by means of a metal drop formed by melting an end of the tube.

3. A high pressure gas discharge lamp as claimed in claim 1, characterized in that the filling gas is a rare gas, preferably neon, argon or xenon.

4. A UV-enhancer as described in claim 1, suitable for use in a high pressure gas discharge lamp.

5. A high pressure gas discharge lamp as claimed in claim 1, characterized in that the metal tube is laser sealed.

6. A high pressure gas discharge lamp as claimed in claim 1, characterized in that the enhancer electrode is made from a metal or metal alloy, the metal being chosen from the group consisting of Niobium, Molybdenum, Tungsten, Iridium, Ruthenium and Rhenium.

7. A high pressure gas discharge lamp as claimed in claim 1, characterized in that the enhancer electrode is made from a mixture of metal or metal alloy and a ceramic material, the metal being chosen from the group consisting of Niobium, Molybdenum, Tungsten, Ruthenium, Iridium and Rhenium, the ceramic material being chosen from the group consisting of $Al_2O_3$, $Y_2O_3$, $Y_3Al_5O_{12}$, $ZrO_2$, MgO, $MgAL_2O_4$, $B_2O_3$ and mixtures thereof.

8. A high pressure gas discharge lamp as claimed in claim 1, characterized in that the material of the wall is chosen from the group comprising YAG, PCA, Mg-oxide doped PCA, MgEr-oxide doped PCA and MgErZr-oxide doped PCA.

* * * * *